US009396920B2

(12) United States Patent
Fukui et al.

(10) Patent No.: US 9,396,920 B2
(45) Date of Patent: Jul. 19, 2016

(54) IONIZATION CHAMBER

(71) Applicant: SHIMADZU CORPORATION, Kyoto-shi, Kyoto (JP)

(72) Inventors: Wataru Fukui, Kyoto (JP); Kazuo Mukaibatake, Kyoto (JP)

(73) Assignee: SHIMADZU CORPORATION, Kyoto (JP)

( * ) Notice: Subject to any disclaimer, the term of this patent is extended or adjusted under 35 U.S.C. 154(b) by 0 days.

(21) Appl. No.: 14/640,137

(22) Filed: Mar. 6, 2015

(65) Prior Publication Data

US 2015/0380226 A1 Dec. 31, 2015

(30) Foreign Application Priority Data

Jun. 27, 2014 (JP) ..... 2014-132302

(51) Int. Cl.
*H01J 49/26* (2006.01)
*H01J 49/04* (2006.01)
*H01J 49/10* (2006.01)

(52) U.S. Cl.
CPC ..... *H01J 49/0445* (2013.01); *H01J 49/10* (2013.01)

(58) Field of Classification Search
USPC ..... 250/281, 282, 283, 288
See application file for complete search history.

(56) References Cited

U.S. PATENT DOCUMENTS 7,569,812 B1 * 8/2009 Karpetsky ..... H01J 49/0468 250/281
2005/0017164 A1 * 1/2005 Mukaibatake ..... 250/288
2015/0021492 A1 * 1/2015 Steiner ..... 250/396 R

FOREIGN PATENT DOCUMENTS

JP 2001-343363 A 12/2001

* cited by examiner

*Primary Examiner* — Nicole Ippolito
(74) *Attorney, Agent, or Firm* — Sughrue Mion, PLLC

(57) ABSTRACT

An ionization chamber 100 is provided between a liquid chromatograph unit 60 and a mass spectrometer 50, and is formed of: an atomization means 15; and an ion introducing pipe 19 of which the entrance portion is created within the ionization chamber 100 in the horizontal direction that is perpendicular to the Z direction and of which the exit portion is created within the mass spectrometer unit 50. A liquid sample that has been fed from the liquid chromatograph unit 60 is sprayed in the Z direction by the atomization means 15 while being ionized within the ionization chamber 100, wherein the entrance portion has an opening in such a form that corresponds to the spread in the XY plane of the liquid sample sprayed in the Z direction. The sprayed liquid sample is then fed into the mass spectrometer unit 50 while being desolvated, which effectively contributes to analysis.

8 Claims, 10 Drawing Sheets

IONIZATION CHAMBER

CROSS-REFERENCE TO RELATED APPLICATIONS

This Application claims priority to Japanese Patent Application No. 2014-132302 filed Jun. 27, 2014, the subject matter of which is incorporated herein by reference in entirety.

BACKGROUND OF THE INVENTION

1. Field of the Invention

The present invention relates to an ionization chamber, and in particular to a liquid chromatograph mass spectrometer having an ionization chamber for ionizing a liquid sample fed from a liquid chromatograph unit and a mass spectrometer unit into which ions are introduced from the ionization chamber.

2. Description of Related Art

Liquid chromatograph mass spectrometers (LC/MS) are formed of a liquid chromatograph unit (LC unit) for eluting a liquid sample so that the liquid sample is separated into respective components, an ionization chamber (interface unit) for ionizing the sample components that have been eluted from the LC unit and a mass spectrometer unit (MS unit) for detecting the ions that have been introduced from the ionization chamber. In such ionization chambers, various ionization techniques are used in order to ionize a liquid sample, and atmospheric pressure ionization methods such as atmospheric pressure chemical ionization (APCI) and electrospray ionization (ESI) are widely used.

In accordance with APCI specifically, the end of a nozzle connected to the terminal of the column in the LC unit is directed toward the inside of the ionization chamber, and at the same time a needle electrode is provided in front of the end of the nozzle. Thus, droplets of the sample that has been atomized through the application of heat in the nozzle are ionized through a chemical reaction with carrier gas ions (buffer ions) that have been generated by means of corona discharge from the needle electrode. In accordance with ESI, the end of a nozzle connected to the terminal of the column in the LC unit is directed toward the inside of the ionization chamber, and at the same time a high voltage of approximately 5 kV is applied to the end portion of the nozzle so that an intense non-uniform electric field is generated. Thus, the liquid sample undergoes charge separation in the electric field so as to be torn off for atomization by means of coulomb attraction. As a result, the solvent in the droplets of the sample evaporates after coming into contact with the surrounding air so that gas ions are generated.

As described above, a liquid sample is ionized in such a state that the sample is placed under pressure that is close to atmospheric pressure in accordance with APCI or ESI. Therefore, a structure is adopted such that middle chambers or the like are provided between the ionization chamber in a high pressure state (that is to say, a state that is close to atmospheric pressure) and the MS unit in a very low pressure state (that is to say a highly vacuumed state) so that the degree of vacuum is increased incrementally in order to secure the difference in the pressure between the ionization chamber and the MS unit (see Patent Document 1).

FIG. 7 is a schematic diagram showing the structure of an example of a liquid chromatograph mass spectrometer in accordance with an ESI method. Here, a certain direction that is horizontal relative to the ground is the X direction, the direction that is horizontal relative to the ground and perpendicular to the X direction is the Y direction, and the direction that is perpendicular to the X direction and the Y direction is the Z direction.

A liquid chromatograph mass spectrometer 101 is provided with a liquid chromatograph unit (LC unit) 60, an ionization chamber 200 and a mass spectrometer unit 50. In addition, a first middle chamber 12 that is adjacent to the ionization chamber 200, a second middle chamber 13 that is adjacent to the first middle chamber 12 and a mass spectrometer chamber (MS unit) 14 that is adjacent to the second middle chamber 13 are provided sequentially, with partitions in between them, in the mass spectrometer unit 50.

The liquid sample that has been separated into the respective components in the LC unit 60 is supplied through a flow path 155. In addition, a nebulizer gas (nitrogen gas) is supplied through a flow path 156. As a result, the liquid sample and the nebulizer gas are introduced into a spray 15 for atomization.

FIGS. 8A and 8B are side diagrams showing the spray. FIG. 8B is a cross-section diagram showing an enlargement of A in FIG. 8A. The spray (atomization means) 15 has a probe main body 151 and a nozzle 152 for atomizing a liquid sample.

The nozzle 152 has a double-pipe structure that is formed so as to protrude downward from the bottom of the probe main body 151. The liquid sample that is supplied through the flow path 155 is ejected from the inside of the internal circular pipe (having an outer diameter of 0.27 mm, for example) 152*b*. Meanwhile, the nitrogen gas supplied through the flow path 156 is ejected between the internal circular pipe 152*b* and the external circular pipe (having an inner diameter of 0.37 mm, for example) 152*a*. As a result, the ejected liquid sample is sprayed in an atomized state due to the effects of impact with the nebulizer gas that is ejected from the space surrounding the internal circular pipe 152*b*. In addition, wires (not shown) are connected to the end of the external circular pipe 152*a* so that a high voltage of approximately 5 kV is applied from the power supply (not shown) in order to achieve ionization.

In addition, the nozzle 152 can move approximately parallel to the probe main body 151 within a predetermined range in the XY plane perpendicular to the Z direction by means of a position-adjusting knob (not shown), and thus the position of nozzle 152 can be fixed using a position-fixing knob after the position has been adjusted appropriately. Furthermore, the nozzle 152 can be inserted and extracted in the Z direction relative to the probe main body 151 (adjustment of the extent of protrusion) and the position of the nozzle 152 can be fixed by means of a nut or the like after the position has been adjusted appropriately.

While in FIGS. 8A and 8B the spray 15 is for ESI, in general the spray 15 is removable from the ionization chamber 200. In the case where an APCI method is used, the spray 15 is removed and instead a spray for APCI, where the needle electrode for charging forms a unit, is attached to the ionization chamber 200.

The ionization chamber 200 is provided with a sub-chamber 210 in a rectangular parallelepiped form of 13 cm×13 cm×12 cm. The sub-chamber 210 has an upper surface, a front surface, a right-side surface, a rear surface (partition 26), a left-side surface and a lower surface. Thus, an internal space surrounded by six surfaces—upper, lower, left, right, front and rear—is formed in the ionization chamber 200.

In addition, a circular opening (not shown) that runs through in the upward and downward directions (Z direction) is created in the upper surface so that a spray 15 can be attached to the opening from the top. Furthermore, a drain 211 is formed on the lower surface so that the unnecessary liquid sample can be discharged to the outside through the drain 211.

Moreover, the partition 26 is provided so as to separate the inside of the sub-chamber 210 from the inside of the first middle chamber 12. A heater block 20 in a rectangular parallelepiped form into which a temperature adjusting mechanism (not shown) is incorporated is fixed in the center portion of the partition 26. FIG. 9 is a diagram showing the structure of the heater block 20 that is provided on the partition 26 in the ionization chamber 200 in FIG. 7.

One desolvation pipe (ion introducing pipe) 119 of which the entrance is provided inside the sub-chamber 210 and of which the exit is provided inside the first middle chamber 12 is formed in the heater block 20. The desolvation pipe 119 is in a circular pipe form having the center axis in the X direction (having an outer diameter of 1.6 mm and an inner diameter of 0.5 mm, for example). As a result, the entrance of the desolvation pipe 119 is pointed in a direction (X direction) that forms approximately a right angle relative to the direction in which the sample is sprayed from the nozzle 152 (Z direction), and a gigantic droplet of the sample that has been sprayed is thus prevented from directly flying into the desolvation pipe 119.

In addition, six dry gas pipes 218 of which the exits are provided inside the sub-chamber 210 are formed in the heater block 20. Each dry gas pipe 218 is in a circular pipe form (having a diameter of 0.5 mm, for example) of which the center axis is in the X direction. The six dry gas pipes 218 are arranged at equal intervals in a circle with the desolvation pipe 119 at the center.

Thus, the partition 26 of the sub-chamber 210 accelerates desolvation and ionization through the effects of the application of heat and of impact when ions and microscopic droplets of the sample that have been sprayed from the nozzle 152 pass through the inside of the desolvation pipe 119.

A first ion lens 21 is provided inside the first middle chamber 12 and an exhaust vent 31 for discharging air by an oil-sealed rotary pump (RP) so as to create a vacuum of approximately $10^2$ Pa is provided in the lower surface of the first middle chamber 12. A skimmer 22 having an orifice is formed in the partition between the first middle chamber 12 and the second middle chamber 13, and the inside of the first middle chamber 12 and the inside of the second middle chamber 13 are connected through this orifice.

An octapole 23 and a focus lens 24 are provided inside the second middle chamber 13, and an exhaust vent 32 for discharging air by means of a turbo molecular pump (TMP) so as to create a vacuum of approximately $10^{-1}$ Pa to $10^{-2}$ Pa is provided in the lower surface of the second middle chamber 13. An entrance lens 25 having an orifice is provided in the partition between the second middle chamber 13 and the mass spectrometer chamber 14, and the inside of the second middle chamber 13 and the inside of the mass spectrometer chamber 14 are connected through this orifice.

A first quadrupole 16, a second quadrupole 17 and a detector 18 are provided inside the mass spectrometer chamber 14, and an exhaust vent 33 for discharging air by means of a turbo molecular pump (TMP) so as to create a vacuum of approximately $10^{-3}$ Pa to $10^{-4}$ Pa is provided in the lower surface of the mass spectrometer chamber 14.

In the thus formed liquid chromatograph mass spectrometer 101, the ions that have been generated in the ionization chamber 200 pass through the desolvation pipe 119, the first ion lens 21 located within the first middle chamber 12, the skimmer 22, the octapole 23 and the focus lens 24 located within the second middle chamber 13 and the entrance lens 25 in this order so as to be fed into the mass spectrometer chamber 14. In this chamber 14 unnecessary ions are discharged by means of the quadrupoles 16 and 17 and only the specific ions that have reached the detector 18 can be detected.

PRIOR ART DOCUMENTS

Patent Documents

Patent Document 1: Japanese Unexamined Patent Publication 2001-343363

SUMMARY OF THE INVENTION

1. Problem to be Solved by the Invention

In the above described liquid chromatograph mass spectrometer 101, however, the desolvation pipe 119 is a single unit, and only part of the liquid sample that has been sprayed from the nozzle 152 passes through the inside of the desolvation pipe 119. Most of the liquid sample is discharged from the drain 211 without passing through the pipe. Therefore, the liquid sample is not effectively used and only part of the liquid sample contributes to the analysis, which is why the detection sensitivity cannot be increased.

In the liquid chromatograph mass spectrometer 101 the appropriate positional relationship between the nozzle 152 that sprays the liquid sample and the entrance of the desolvation pipe 119 defers depending on the measurement conditions such as the type of the liquid sample to be measured and the amount of the flow of the nebulizer gas. Therefore, the positional relationship between the nozzle 152 and the entrance of the desolvation pipe 119 is adjusted appropriately before analysis. However, most of the liquid sample is discharged from the drain 211 without passing through the pipe

2. Means for Solving Problem

In order to solve the above described problem, the present inventors carried out research to find a method for desolvating the liquid sample that has been sprayed from the nozzle 152 while feeding the desolvated liquid sample to the mass spectrometer unit so that the liquid sample effectively contributes to the analysis.

The flow of the atomized liquid sample that has been sprayed from the nozzle 152 with an inner diameter of 0.5 mm spreads as it proceeds in a circular form in the Z direction and ultimately increases in size to a diameter of approximately +/−2 mm to 4 mm. FIG. 10A is a side diagram showing the flow of the atomized liquid sample that has been sprayed from the nozzle 152. FIG. 10B is a cross section diagram showing the XY plane in FIG. 10A. FIG. 11 is a diagram illustrating the spread of the flow of the atomized liquid sample that has been sprayed from the nozzle 152.

The ionized liquid sample (charged droplets) is sprayed into the inside of the sub-chamber 210 under atmospheric pressure and is drawn into the desolvation pipe 119 due to the difference in the pressure vis-à-vis the inside of the first middle chamber 12 where the pressure is maintained at approximately $10^2$ Pa. Thus the charged droplets are ejected with great force in the direction perpendicular to the desolvation pipe 119 (Z direction) and it was found that the charged droplets that pass through a part of the sub-chamber 210 that is far from the desolvation pipe 119 are not taken into the desolvation pipe 119 but are discharged through the drain 211.

Thus, it is possible to increase the inner diameter d of the desolvation pipe 119 in order to increase the total amount of ions (charged droplets) that are taken into the desolvation pipe 119. Here the general state of the flow within the pipe can be determined by the numeric value of the Reynolds number Re that is defined in Formula (1) in the following.

$$Re=\rho Ud/\mu \quad (1)$$

Here, μ is the viscosity coefficient (Pa·s) of the liquid, ρ is the density (kg/m$^3$) of the liquid, U is the rate of flow (m/s) and d is the inner diameter (m) of the pipe.

In the case where the Reynolds number Re exceeds 2000 the flow of the gas within the pipe becomes a turbulent flow as shown in the graph of the Reynolds number Re in FIG. 12. When the flow is turbulent the efficiency of the introduction of ions is lowered. That is to say, when the inner diameter d of the desolvation pipe 119 is increased, the flow field within the desolvation pipe 119 is disturbed and the efficiency of the introduction of ions decreases.

It was found that the inner diameter of the desolvation pipe (ion introducing pipe) can be determined taking the Reynolds number Re into consideration, and in addition the ion introducing pipe can be placed for better coordination with the form of the sprayed flow, so that the liquid sample that has been sprayed from the nozzle can be taken into the ion introducing pipe without being wasted.

That is to say, the ionization chamber according to the present invention is an ionization chamber that is provided between a liquid chromatograph unit and a mass spectrometer with: an atomization means for spraying a liquid sample that has been fed from the above described liquid chromatograph unit in the Z direction in the above described ionization chamber while ionizing the liquid sample; and an ion introducing pipe of which an entrance portion is created within the above described ionization chamber in the horizontal direction that is perpendicular to the Z direction and of which an exit portion is created so as to introduce ions into the above described mass spectrometer unit, wherein an opening in the above described entrance portion has such a form as to correspond to the spread in the XY plane of the liquid sample sprayed in the Z direction.

Here, the "Z direction" is the direction in which the liquid sample is sprayed from the atomization means and any one direction, for example the downward direction, that is predetermined by the designer of the system or somebody else.

3. Effects of the Invention

As described above, in the ionization chamber according to the present invention, the ion introducing pipe is placed for better coordination with the form of the sprayed flow, and thus the charged droplets that have been discharged without being introduced into the mass spectrometer unit due to the large distance between them and the entrance of the ion introducing pipe according to the prior art can be drawn into the ion introducing pipe, and as a result the detection sensitivity can be increased.

4. Other Means for Solving Problem

In addition, in the ionization chamber according to the present invention, the opening of the above described entrance portion may have such a shape that is longer in the horizontal direction than in the Z direction.

Here, the length of the "opening of the entrance portion" in the horizontal direction is the length of the entrance (opening) in the horizontal direction in the case where the entrance portion has one opening. In the case where the entrance portion has a number of openings, the length of the "opening of the entrance portion" is the total length in the horizontal direction when the number of entrances (openings) are viewed in the Z direction. Likewise, the length of the "entrance of the entrance portion" in the Z direction is the length of the entrance (opening) in the Z direction when the entrance portion has one opening. In the case where the entrance portion has a number of openings, the length of the "entrance of the entrance portion" is the total length of the number of entrances (openings) in the Z direction when the entrances are viewed in the horizontal direction.

Furthermore, in the ionization chamber according to the present invention, the above described entrance portion may have a number of entrances, and the number of entrances may be provided in the same XY plane.

In the ionization chamber according to the present invention, a number of ion introducing pipes may be provided in parallel so that the total area of the cross section of the inner diameters of the ion introducing pipes can be increased and thus ions can be efficiently introduced into the mass spectrometer unit while increasing the total amount of ions to be introduced without disturbing the flow through the inside of each pipe. As a result, the detection sensitivity can be increased.

Moreover, in the ionization chamber according to the present invention, the number of entrances may all be placed so as to face in the X direction.

Alternatively, in the ionization chamber according to the present invention, the number of entrances may be placed so as to face in directions different from each other.

In addition, in the ionization chamber according to the present invention the above described entrance portion may have an entrance of which the shape may be longer in the horizontal direction than in the Z direction.

Furthermore, in the ionization chamber according to the present invention, the inside of the above described ionization chamber is under atmospheric pressure, and the inside of the above described mass spectrometer unit may be a vacuum.

DETAILED DESCRIPTION OF EMBODIMENTS

In the following, the embodiments of the present invention are described in reference to the drawings. Here, the present invention is not limited to the below described embodiments but of course includes various types of modification as long as the gist of the present invention is not deviated from.

First Embodiment

Figure 1:
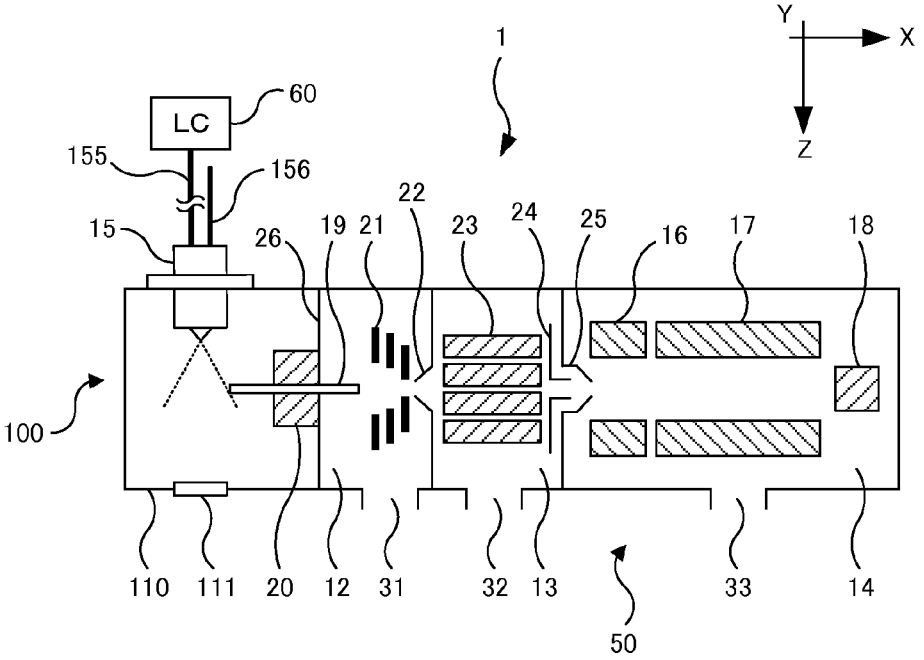
FIG. 1 is a schematic diagram showing the structure of an example of the liquid chromatograph mass spectrometer using an ESI method according to one embodiment of the present invention.
Figure 2:
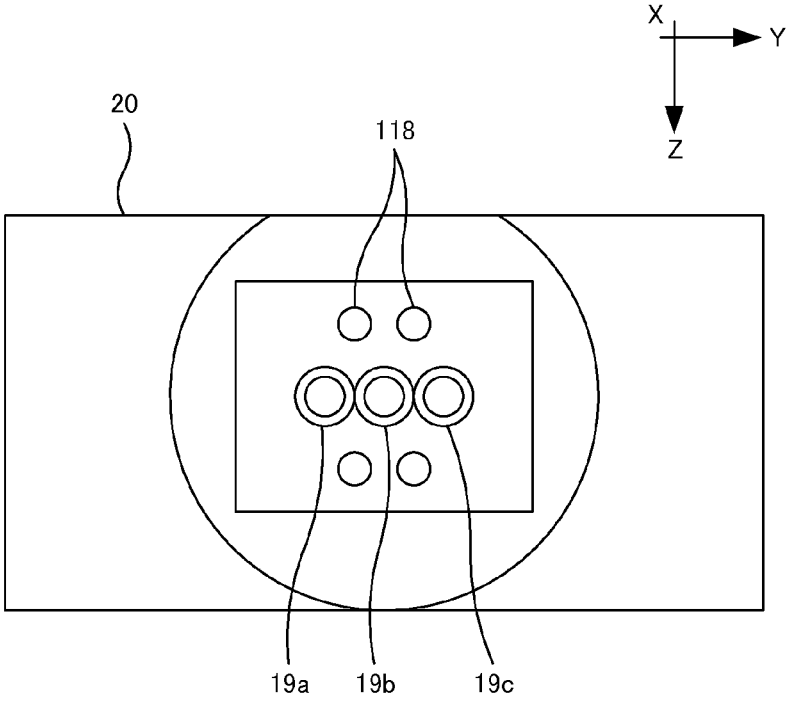
FIG. 2 is a diagram showing the structure of the heater block provided on the partition of the ionization chamber in FIG. 1.
Figure 3A:
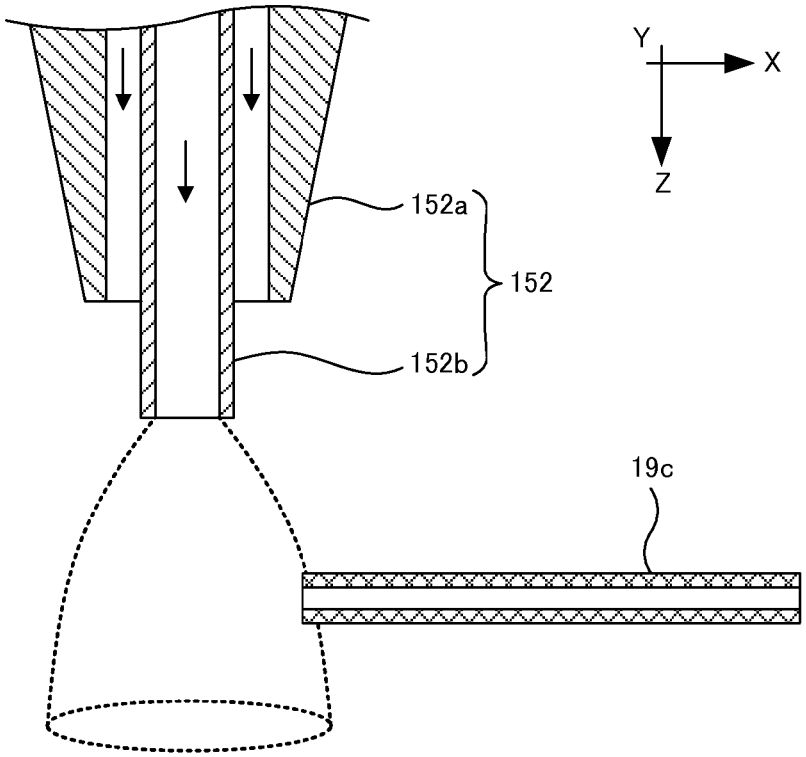
FIGS. 3A and 3B are diagrams showing the flow of the atomized liquid sample that has been sprayed from the nozzle.
Figure 3B:
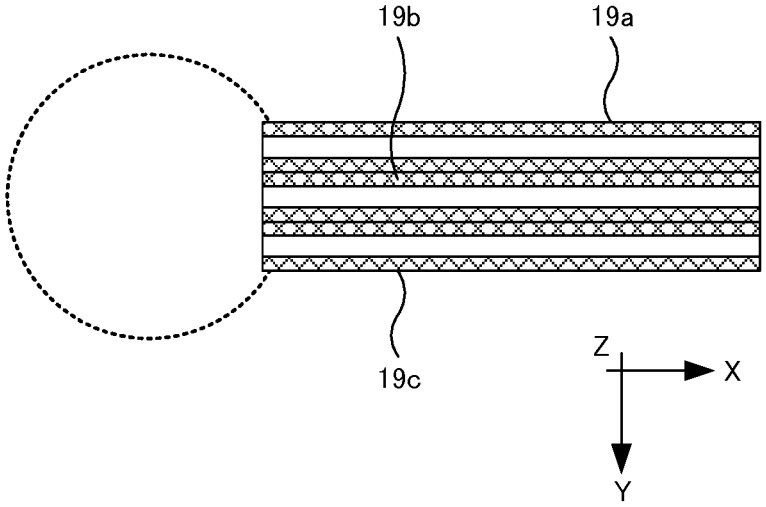

FIG. 1 is a schematic diagram showing the structure of an example of the liquid chromatograph mass spectrometer using an ESI method according to one embodiment of the present invention. FIG. 2 is a diagram showing the structure of the heater block provided on the partition 26 of the ionization chamber 100 in FIG. 1. FIG. 3A is a side diagram showing the flow of the atomized liquid sample that has been sprayed from the nozzle 152. FIG. 3B is a cross section diagram showing the XY plane in FIG. 3A. Here, the same symbols are attached to the same components as in the above described conventional liquid chromatograph mass spectrometer 101.

A liquid chromatograph mass spectrometer 1 is provided with a liquid chromatograph unit (LC unit) 60, an ionization chamber 100 and amass spectrometer unit 50. In addition, a first middle chamber 12 that is located adjacent to the ionization chamber 100, a second middle chamber 13 that is located adjacent to the first middle chamber 12 and a mass spectrometer chamber (MS unit) 14 that is adjacent to the second middle chamber 13 are provided sequentially with partitions in between them in the mass spectrometer unit 50.

The ionization chamber 100 is provided with a sub-chamber 110 in a rectangular parallelepiped form of 13 cm×13 cm×12 cm. The sub-chamber 110 has an upper surface, a front surface, a right-side surface, a rear surface (partition 26), a left-side surface and a lower surface. Thus, an internal space surrounded by six surfaces—upper, lower, left, right, front and rear—is formed in the ionization chamber 100.

In addition, a circular opening (not shown) that runs through in the upward and downward directions (Z direction) is created in the upper surface so that a spray 15 can be attached to the opening from the top. Furthermore, a drain 111 is formed on the lower surface so that the unnecessary liquid sample can be discharged to the outside through the drain 111.

Moreover, the partition 26 is provided so as to separate the inside of the sub-chamber 110 from the inside of the first middle chamber 12. A heater block 20 in a rectangular parallelepiped form into which a temperature adjusting mechanism (not shown) is incorporated is fixed in the center portion of the partition 26.

A first desolvation pipe 19*a*, a second desolvation pipe 19*b* and a third desolvation pipe 19*c*, which are ion introducing pipes of which the entrance is placed inside the sub-chamber 110 and of which the exit is placed inside the first middle chamber 12 are formed in the heater block 20. Each desolvation pipe 19*a* to 19*c* is in a circular pipe form having the center axis in the X direction (having an outer diameter of 1.6 mm and an inner diameter of 0.5 mm, for example). As shown in FIG. 2, the first desolvation pipe 19*a*, the second desolvation pipe 19*b* and the third desolvation pipe 19*c* are aligned in this order side by side in the Y direction in the same XY plane.

As in FIGS. 3A and 3B, the entrance of the first desolvation pipe 19*a*, the entrance of the second desolvation pipe 19*b* and the entrance of the third desolation pipe 19*c* are provided in the same ZY plane. However, the flow of the atomized liquid sample that has been sprayed from the nozzle 152 is in a circular form in the XY plane, and therefore the entrance of the first desolvation pipe 19*a* and the entrance of the third desolvation pipe 19*c* may be located so as to protrude from the entrance of the second desolvation pipe 19*b* in the −X direction.

In addition, four dry gas pipes 118 of which the exits are provided inside the sub-chamber 110 are formed in the heater block 20. Each dry gas pipe 118 is in a circular pipe form having the center axis in the X direction (having a diameter of 0.5 mm, for example). Two dry gas pipes 118 are aligned side by side in the Y direction above the desolvation pipes 19*a* to 19*c* and at the same time two dry gas pipes 118 are aligned side by side in the Y direction beneath the desolvation pipes 19*a* to 19*c*.

The partition 26 of the thus formed sub-chamber 110 allows the flow of the atomized liquid sample that has been sprayed from the nozzle 152 having an inner diameter of 0.5 mm to spread as the flow progresses in the Z direction and ultimately increase in size to a diameter of approximately +/−2 mm to 4 mm. The ions that pass through the left end portion of the flow of the atomized liquid sample (−Y side) are drawn into the first desolvation pipe 19*a* having an inner diameter of 0.5 mm. The ions that pass through the center portion of the flow of the atomized liquid sample are drawn into the second desolvation pipe 19*b* having an inner diameter of 0.5 mm. The ions that pass through the right end portion of the flow of the atomized liquid sample (Y side) are drawn into the third desolvation pipe 19*c* having an inner diameter of 0.5 mm.

As described above, in the liquid chromatograph mass spectrometer 1 according to the present invention, three desolvation pipes (ion introducing pipes) 19*a* to 19*c* are placed for better coordination with the form of the sprayed flow, so that almost all of the charged droplets can be brought into the three desolvation pipes 19*a* to 19*c*. As a result, the detection sensitivity can be increased. In addition, the three desolvation pipes (ion introducing pipes) 19*a* to 19*c* are aligned in parallel so that the total area of cross-section of the inside of the desolvation pipes 19*a* to 19*c* can be increased. Thus, the total amount of ions that can be introduced into the first middle chamber 12 can be increased and at the same time ions can be efficiently introduced without disturbing the flow through the inside of each desolvation pipe 19*a* to 19*c*. As a result the detection sensitivity can be increased.

Second Embodiment

Figure 4A:
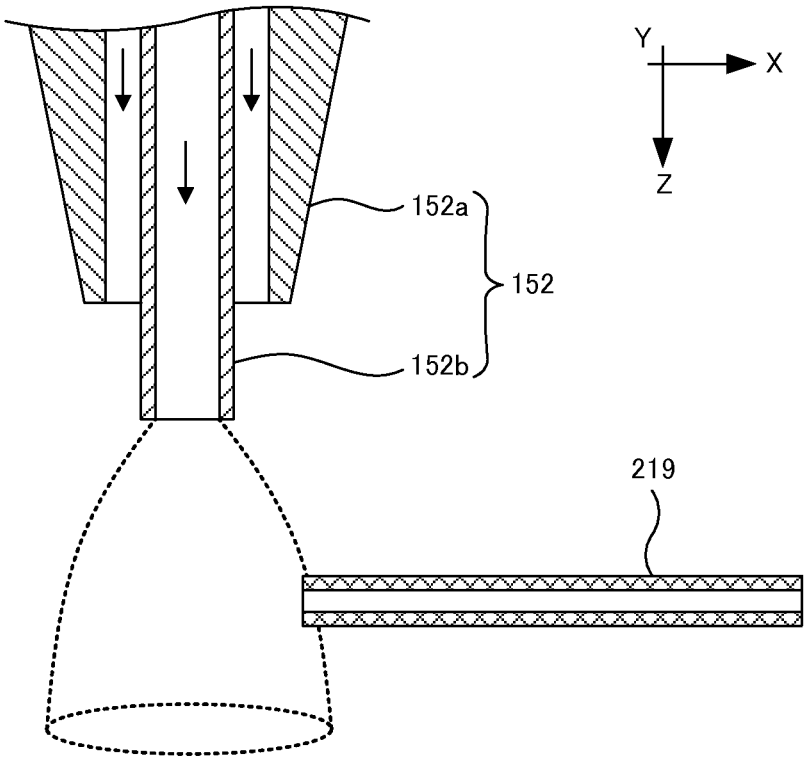
FIGS. 4A and 4B are diagrams showing the ionization chamber in the liquid chromatograph mass spectrometer using an ESI method according to the second embodiment.
Figure 4B:
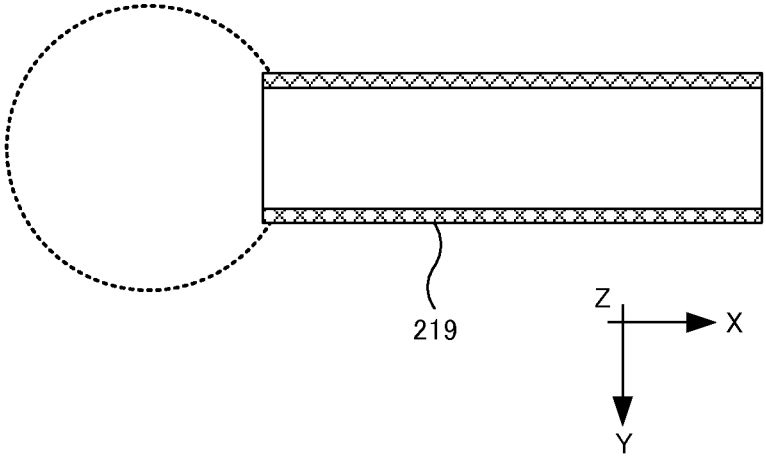

FIGS. 4A and 4B are diagrams showing the ionization chamber of the liquid chromatograph mass spectrometer using an ESI method according to the second embodiment. FIG. 4A is a side diagram showing the flow of the atomized liquid sample that has been sprayed from the nozzle 152 and FIG. 4B is a cross section diagram showing the XY plane in FIG. 4A. Here, the same symbols are attached to the same components in the above described conventional liquid chromatograph mass spectrometer 1.

An ionization chamber 100 is provided with a sub-chamber 110 in a rectangular parallelepiped form of 13 cm×13 cm×12 cm. The sub-chamber 110 has an upper surface, a front surface, a right-side surface, a rear surface (partition 26), a left-side surface and a lower surface.

The partition 26 is provided so as to separate the inside of the sub-chamber 110 from the inside of the first middle chamber 12. A heater block 20 in a rectangular parallelepiped form into which a temperature adjusting mechanism (not shown) is incorporated is fixed in the center portion of the partition 26.

One desolvation pipe (ion introducing pipe) 219 of which the entrance is placed inside the sub-chamber 110 and of which the exit is placed inside the first middle chamber 12 are formed in the heater block 20. The desolvation pipe 219 is a rectangular pipe having its center axis in the X direction (having long sides of 1.6 mm and short sides of 0.5 mm) and is provided so that the long sides are directed in the Y direction.

The partition 26 of the thus formed sub-chamber 110 allows the flow of the atomized liquid sample that has been sprayed from the nozzle 152 having an inner diameter of 0.5 mm to spread as the flow progresses in the Z direction and ultimately increase in size to a diameter of approximately +/−2 mm to 4 mm. The ions that pass through the left end portion of the flow of the atomized liquid sample are drawn into the left end portion of the desolvation pipe 219. The ions that pass through the center portion of the flow of the atomized liquid sample are drawn into the center portion of the desolvation pipe 219. The ions that pass through the right end portion of the flow of the atomized liquid sample are drawn into the right end portion of the desolvation pipe 219.

Third Embodiment

Figure 5A:
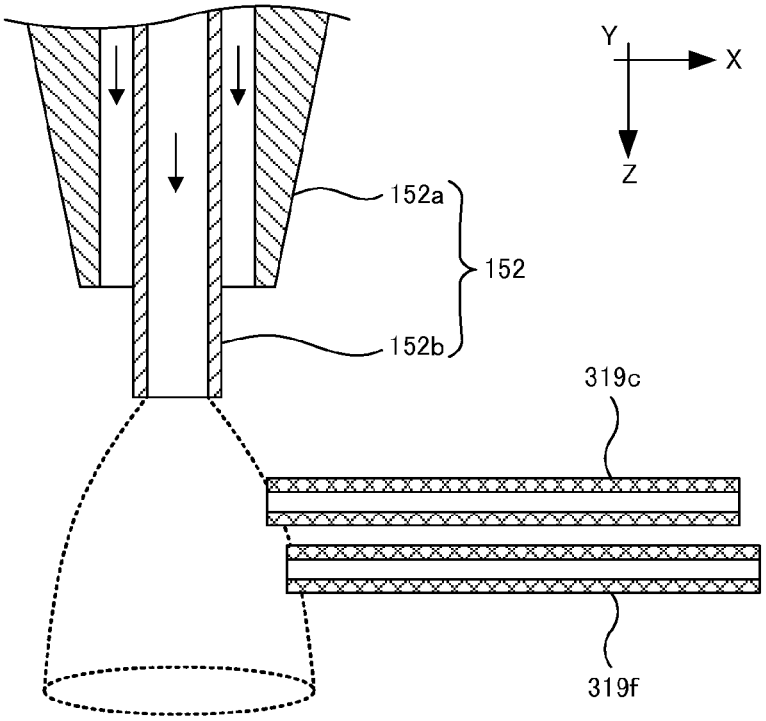
FIGS. 5A and 5B are diagrams showing the ionization chamber according to the third embodiment in the same manner as in FIG. 4.
Figure 5B:
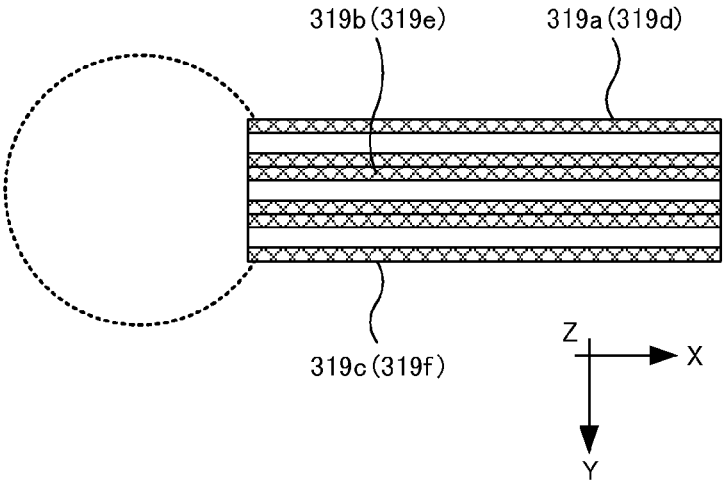

FIGS. 5A and 5B are diagrams showing the ionization chamber of the liquid chromatograph mass spectrometer using an ESI method according to the third embodiment. FIG. 5A is a side diagram showing the flow of the atomized liquid sample that has been sprayed from the nozzle 152 and FIG. 5B is a cross section diagram showing the XY plane in FIG. 5A. Here, the same symbols are attached to the same components in the above described conventional liquid chromatograph mass spectrometer 1.

An ionization chamber 100 is provided with a sub-chamber 110 in a rectangular parallelepiped form of 13 cm×13 cm×12 cm. The sub-chamber 110 has an upper surface, a front surface, a right-side surface, a rear surface (partition 26), a left-side surface and a lower surface.

The partition 26 is provided so as to separate the inside of the sub-chamber 110 from the inside of the first middle chamber 12. A heater block 20 in a rectangular parallelepiped form into which a temperature adjusting mechanism (not shown) is incorporated is fixed in the center portion of the partition 26.

A first desolvation pipe 319*a* to a sixth desolvation pipe 319*f*, which are ion introducing pipes of which the entrance is placed inside the sub-chamber 110 and of which the exit is placed inside the first middle chamber 12 are formed in the heater block 20. Each desolvation pipe 319*a* to 319*f* is in a circular pipe form having the center axis in the X direction (having an outer diameter of 1.6 mm and an inner diameter of 0.5 mm, for example). The first desolvation pipe 319*a* to the third desolvation pipe 319*c* are aligned in this order side by side in the Y direction in a first XY plane, and the fourth desolvation pipe 319*d* to the sixth desolvation pipe 319*f* are aligned in this order side by side in the Y direction in a second XY plane that is located beneath the first XY plane.

The flow of the atomized liquid sample that has been sprayed from the nozzle 152 is in a conical form having the nozzle 152 as its apex, therefore the entrances of the first desolvation pipe 319*a* to the third desolvation pipe 319*c* are placed so as to protrude from the entrances of the fourth desolvation pipe 319*d* to the sixth desolvation pipe 319*f* in the −X direction.

The partition 26 of the thus formed sub-chamber 110 allows the flow of the atomized liquid sample that has been sprayed from the nozzle 152 having an inner diameter of 0.5 mm to spread as the flow progresses in the Z direction and ultimately increase in size to a diameter of approximately +/−2 mm to 4 mm. First, in the first XY plane, the ions that pass through the left end portion of the flow of the atomized liquid sample are drawn into the first desolvation pipe 319*a* having an inner diameter of 0.5 mm, the ions that pass through the center portion of the flow of the atomized liquid sample are drawn into the second desolvation pipe 319*b* having an inner diameter of 0.5 mm, and the ions that pass through the right end portion of the flow of the atomized liquid sample are drawn into the third desolvation pipe 319*c* having an inner diameter of 0.5 mm. Next, in the second XY plane, the ions that pass through the left end portion of the flow of the atomized liquid sample are drawn into the fourth desolvation pipe 319*d* having an inner diameter of 0.5 mm, the ions that pass through the center portion of the flow of the atomized liquid sample are drawn into the fifth desolvation pipe 319*e* having an inner diameter of 0.5 mm, and the ions that pass through the right end portion of the flow of the atomized liquid sample are drawn into the sixth desolvation pipe 319*f* having an inner diameter of 0.5 mm.

Fourth Embodiment

Figure 6A:
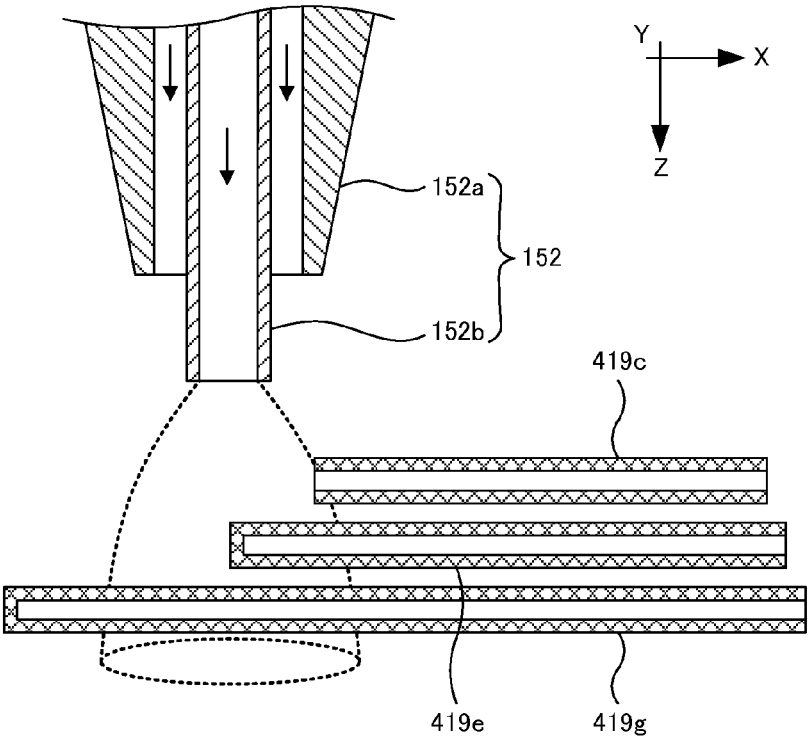
FIGS. 6A and 6B are diagrams showing the ionization chamber according to the fourth embodiment in the same manner as in FIG. 4.
Figure 6B:
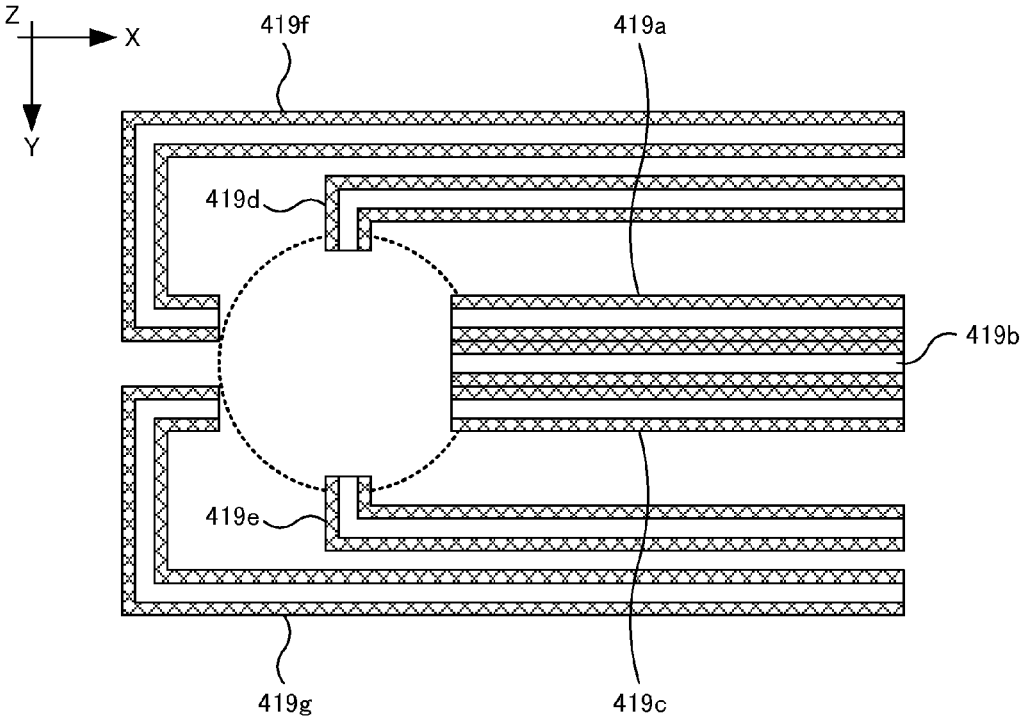
Figure 7:
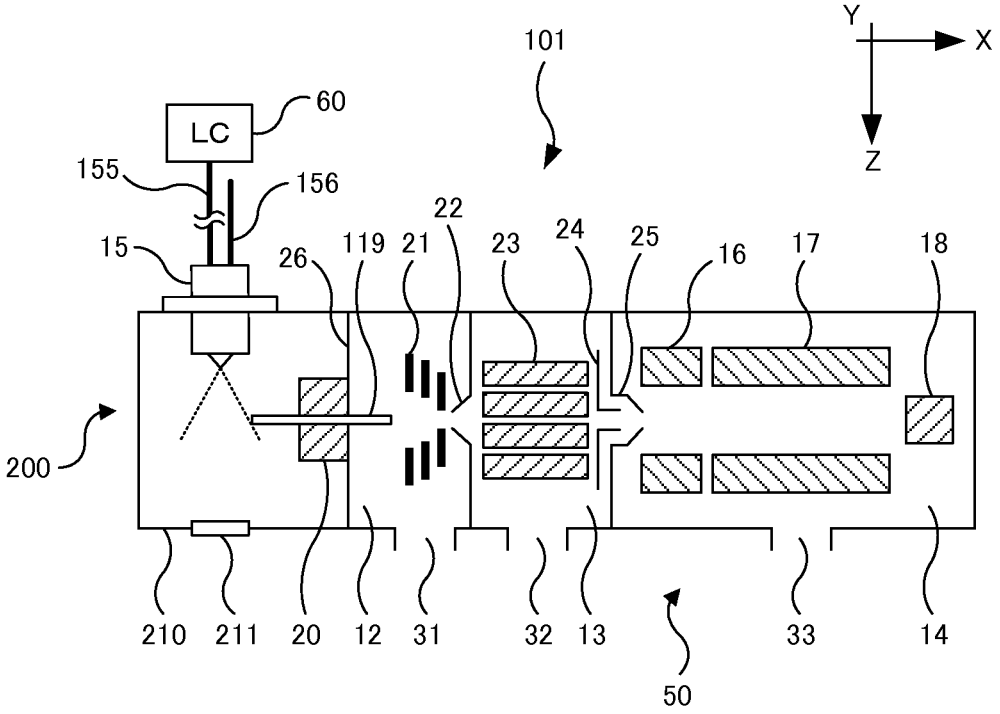
FIG. 7 Prior Art
FIG. 7 is a schematic diagram showing the structure of an example of a liquid chromatograph mass spectrometer using an ESI method.
Figure 8A:
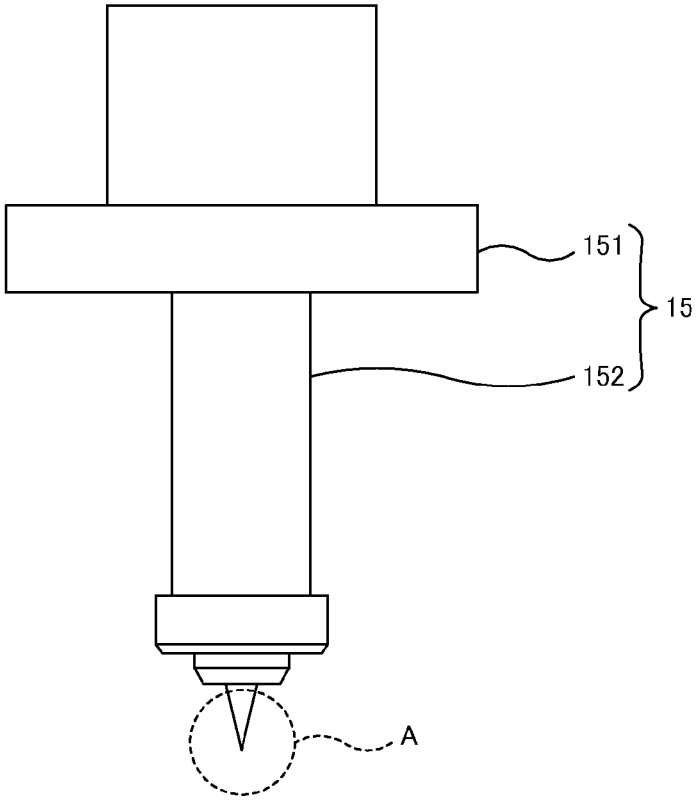
Prior Art FIG. 8A
FIGS. 8A and 8B are diagrams showing a spray.
Figure 8B:
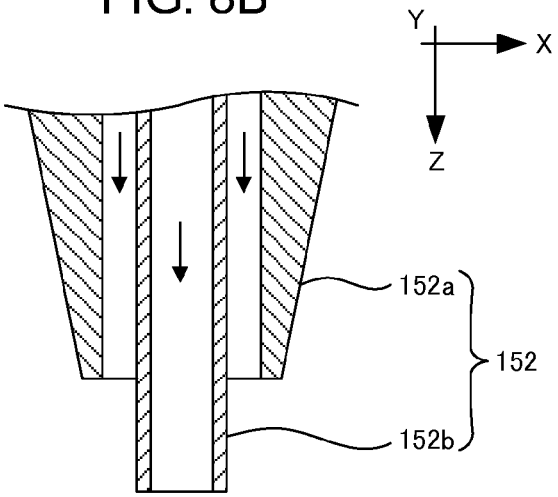
Figure 9:
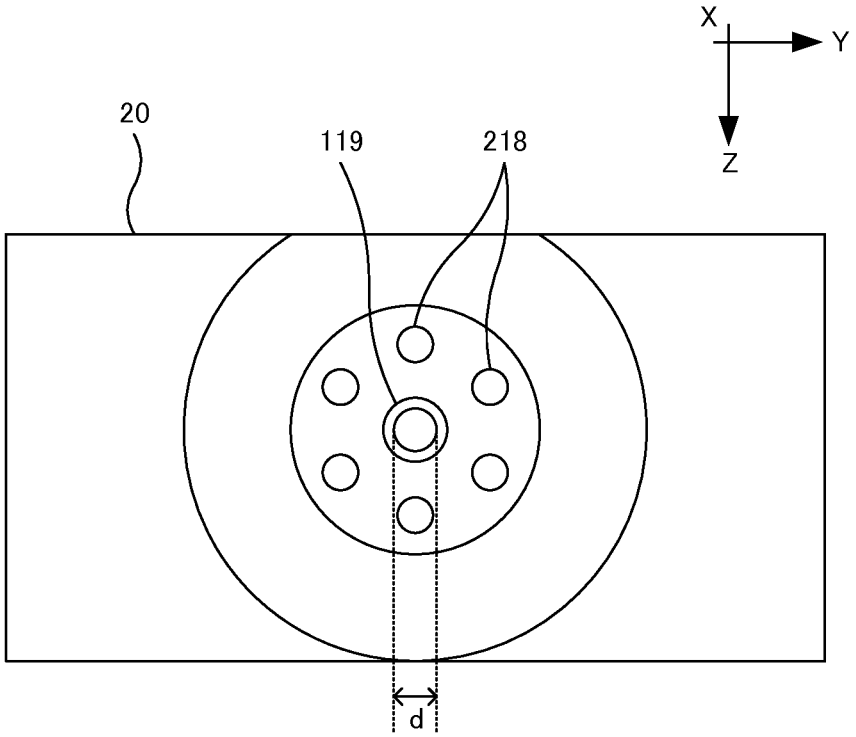
FIG. 9 Prior Art
FIG. 9 is a diagram showing the structure of the heater block provided on the partition of the ionization chamber in FIG. 7.
Figure 10A:
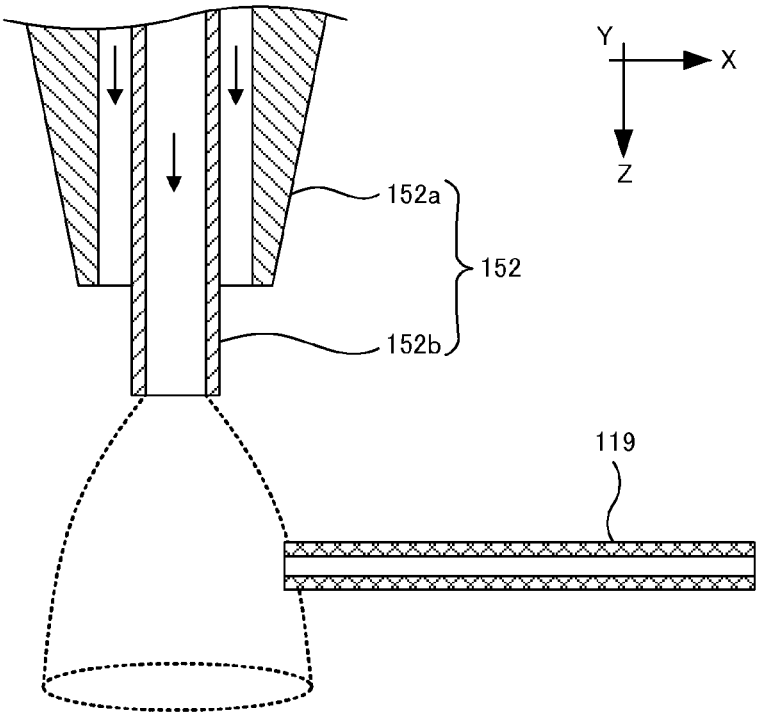
Prior Art FIG. 10A
FIGS. 10A and 10B are diagrams showing the flow of the atomized liquid sample that has been sprayed from the nozzle.
Figure 10B:
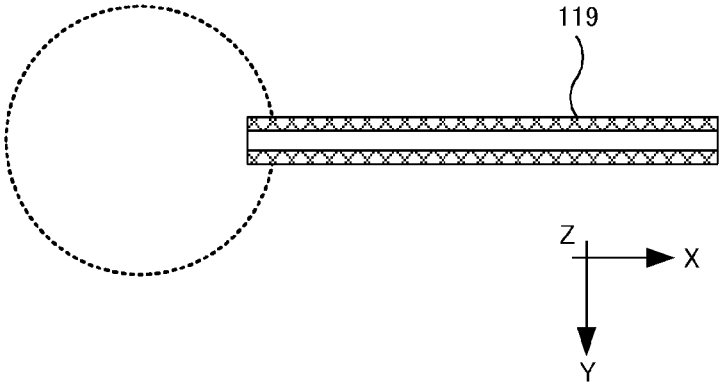
Figure 11:
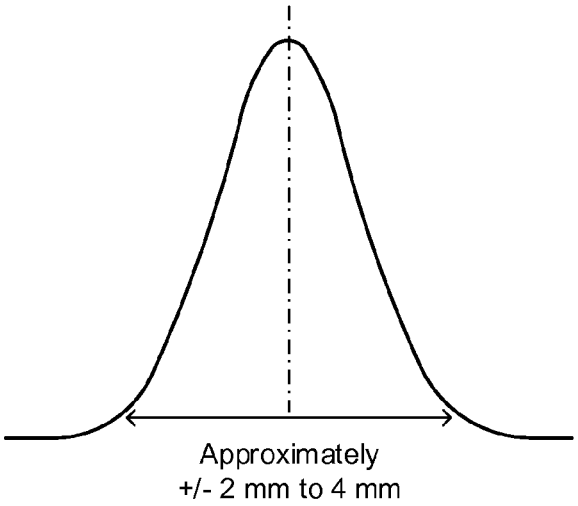
FIG. 11 is a diagram illustrating the spread of the flow of the atomized liquid sample that has been sprayed from the nozzle.
Figure 12:
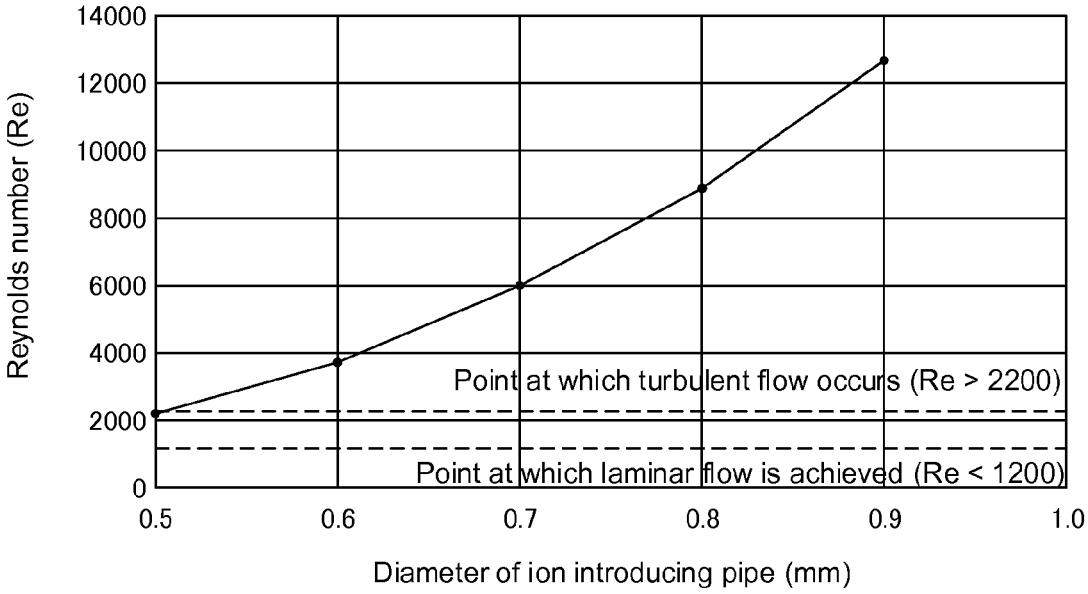
FIG. 12 is a graph showing the Reynolds numbers.

FIGS. 6A and 6B are diagrams showing the ionization chamber of the liquid chromatograph mass spectrometer using an ESI method according to the fourth embodiment. FIG. 6A is a side diagram showing the flow of the atomized liquid sample that has been sprayed from the nozzle 152 and FIG. 6B is a cross section diagram showing the XY plane in FIG. 6A. Here, the same symbols are attached to the same components in the above described conventional liquid chromatograph mass spectrometer 1.

An ionization chamber 100 is provided with a sub-chamber 110 in a rectangular parallelepiped form of 13 cm×13 cm×12 cm. The sub-chamber 110 has an upper surface, a front surface, a right-side surface, a rear surface (partition 26), a left-side surface and a lower surface.

The partition 26 is provided so as to separate the inside of the sub-chamber 110 from the inside of the first middle chamber 12. A heater block 20 in a rectangular parallelepiped form into which a temperature adjusting mechanism (not shown) is incorporated is fixed in the center portion of the partition 26.

A first desolvation pipe 419*a* to a seventh desolvation pipe 419*g*, which are ion introducing pipes of which the entrance is placed inside the sub-chamber 110 and of which the exit is placed inside the first middle chamber 12 are formed in the heater block 20. Each desolvation pipe 419*a* to 419*g* has a circular pipe form (having an outer diameter of 1.6 mm and an inner diameter of 0.5 mm, for example). The first desolvation pipe 419*a* to the third desolvation pipe 419*c* are provided in a first XY plane, the fourth desolvation pipe 419*d* and the fifth desolvation pipe 419*e* are provided in a second XY plane that is located beneath the first XY plane, and the sixth desolvation pipe 419*f* and the seventh desolvation pipe 419*g* are provided in a third XY plane that is located beneath the second XY plane.

In addition, the first desolvation pipe 419*a*, the second desolvation pipe 419*b* and the third desolvation pipe 419*c* are in a circular pipe form having its center axis in the X direction (having an outer diameter of 1.6 mm and an inner diameter of 0.5 mm, for example), and are aligned in this order side by side in the Y direction in the first XY plane. That is to say, the entrance of the first desolvation pipe 419*a*, the entrance of the second desolvation pipe 419*b* and the entrance of the third desolvation pipe 419*c* are directed so as to face the X direction in the first XY plane. In addition, the entrance of the fourth desolvation pipe 419*d* is directed so as to face the Y direction and at the same time the entrance of the fifth desolvation pipe 419*e* is directed to face the −Y direction in the second XY plane. Furthermore, the entrance of the sixth desolvation pipe 419*f* is directed so as to face the −X direction and at the same time the entrance of the seventh desolvation pipe 419*g* is directed to face the −X direction in the third XY plane.

The partition 26 of the thus formed sub-chamber 110 allows the flow of the atomized liquid sample that has been sprayed from the nozzle 152 having an inner diameter of 0.5 mm to spread as the flow progresses in the Z direction and ultimately increase in size to a diameter of approximately +/−2 mm to 4 mm. First, in the first XY plane, the ions that pass through the left end portion of the flow of the atomized liquid sample are drawn into the first desolvation pipe 419*a* having an inner diameter of 0.5 mm, the ions that pass through the center portion of the flow of the atomized liquid sample are drawn into the second desolvation pipe 419*b* having an inner diameter of 0.5 mm, and the ions that pass through the right end portion of the flow of the atomized liquid sample are drawn into the third desolvation pipe 419*c* having an inner diameter of 0.5 mm. Next, in the second XY plane, the ions that pass through the center left portion of the flow of the atomized liquid sample are drawn into the fourth desolvation pipe 419*d* having an inner diameter of 0.5 mm, and the ions that pass through the center right portion of the flow of the atomized liquid sample are drawn into the fifth desolvation pipe 419*e* having an inner diameter of 0.5 mm. Finally, in the third XY plane, the ions that pass through the rear left portion of the flow of the atomized liquid sample are drawn into the sixth desolvation pipe 419*f* having an inner diameter of 0.5 mm, and the ions that pass through the rear right portion of the flow of the atomized liquid sample are drawn into the seventh desolvation pipe 419*g* having an inner diameter of 0.5 mm.

Other Embodiments

While the liquid chromatograph mass spectrometer 1 has such a configuration that an ESI method is used as described above, an APCI method or other ionization techniques may be used in the configuration.

INDUSTRIAL APPLICABILITY

The present invention can be applied to a mass spectrometer and the like having an ionization chamber.

Explanation of Symbols

15 spray (atomization means)
19 desolvation pipe (ion introducing pipe)
50 mass spectrometer unit
60 liquid chromatograph unit (LC unit)
100 ionization chamber

What is claimed is:

1. An ionization chamber provided between a liquid chromatograph unit and a mass spectrometer, comprising:

an atomization means for spraying a liquid sample that has been fed from said liquid chromatograph unit in the Z direction in said ionization chamber while ionizing the liquid sample; and an ion introducing pipe of which an entrance portion is created within said ionization chamber in the horizontal direction that is perpendicular to the Z direction and of which an exit portion is created so as to introduce ions into said mass spectrometer unit, characterized in that an opening in said entrance portion has such a form as to correspond to the spread in the XY plane of the liquid sample sprayed in the Z direction.

2. The ionization chamber according to claim 1, characterized in that the opening of said entrance portion has such a shape that is longer in the horizontal direction than in the Z direction.

3. The ionization chamber according to claim 1, characterized in that said entrance portion has a number of entrances, and the number of entrances are provided in the same XY plane.

4. The ionization chamber according to claim 3, characterized in that the number of entrances are all placed so as to face in the X direction.

5. The ionization chamber according to claim 3, characterized in that the number of entrances are placed so as to face in directions different from each other.

6. The ionization chamber according to claim 1, characterized in that said entrance portion has an entrance of which the shape is longer in the horizontal direction than in the Z direction.

7. The ionization chamber according to claim 1, characterized in that the inside of said ionization chamber is under atmospheric pressure, and the inside of said mass spectrometer unit is a vacuum.

8. The ionization chamber according to claim 1, wherein charged droplets that have been discharged without being introduced into the mass spectrometer unit due to a distance between the droplets and the entrance of the ion introducing pipe are drawn into the ion introducing pipe.

* * * * *